US005419452A

United States Patent [19]

Mueller et al.

[11] Patent Number: 5,419,452

[45] Date of Patent: May 30, 1995

[54] FASTENING DEVICE FOR CONTAINER LINERS

[76] Inventors: Jay Mueller, 9900 Crestwick Dr., St. Louis, Mo. 63128; Stephen B. Ashby, 7256 Balson, University City, Mo. 63130

[21] Appl. No.: 152,533

[22] Filed: Nov. 16, 1993

Related U.S. Application Data

[60] Division of Ser. No. 858,684, Mar. 27, 1992, Pat. No. 5,261,553, which is a continuation-in-part of Ser. No. 542,815, Jun. 25, 1990, Pat. No. 5,100,087, which is a continuation of Ser. No. 319,044, Mar. 6, 1989, abandoned, which is a continuation of Ser. No. 141,546, Jan. 7, 1988, abandoned.

[51] Int. Cl.[6] ..... B65D 1/06

[52] U.S. Cl. ..... 220/404; 220/908

[58] Field of Search ..... 220/908, 404, 403; 248/95, 97, 98, 99, 100, 101

[56] References Cited

U.S. PATENT DOCUMENTS

| | | | |
|---|---|---|---|
| 1,953,042 | 3/1934 | Cody | 248/101 |
| 3,222,019 | 12/1965 | Weisberg | 248/100 |
| 3,522,922 | 4/1970 | Byron et al. | 248/101 |
| 4,027,774 | 6/1977 | Cote | 248/99 |
| 4,437,634 | 3/1984 | Hambleton | 248/97 |
| 4,445,658 | 5/1984 | Ferron | 248/99 |
| 4,457,483 | 7/1984 | Gagne | 248/97 |
| 4,471,880 | 9/1984 | Taylor et al. | 220/306 |
| 4,509,570 | 4/1985 | Eby et al. | 248/97 |
| 4,535,911 | 8/1985 | Goulter | 220/404 |
| 4,576,310 | 3/1986 | Isgav et al. | 220/404 |
| 4,620,683 | 11/1986 | Claydon et al. | 248/97 |
| 4,638,968 | 1/1987 | Auten | 248/97 |
| 4,664,347 | 5/1987 | Brown et al. | 248/97 |
| 4,690,357 | 9/1987 | Webster | 248/99 |
| 4,715,767 | 12/1987 | Edelhoff et al. | 414/408 |
| 4,735,340 | 4/1988 | Preston | 220/404 |
| 4,760,983 | 8/1988 | McNerney | 248/100 |
| 4,763,808 | 8/1988 | Guhl et al. | 248/100 X |
| 4,923,087 | 5/1990 | Burrows | 220/404 |
| 4,957,252 | 9/1990 | Watkins | 248/97 |
| 4,997,149 | 3/1991 | Koch | 220/404 |
| 5,005,727 | 4/1991 | Roth | 220/404 |
| 5,018,637 | 5/1991 | Miller | 220/908 |
| 5,090,585 | 2/1992 | Power | 220/908 |
| 5,100,087 | 3/1992 | Ashby | 248/97 |
| 5,251,779 | 10/1993 | Schmidt | 220/908 |
| 5,261,553 | 11/1993 | Mueller et al. | 220/404 |

*Primary Examiner*—Stephen J. Castellano
*Attorney, Agent, or Firm*—Heller & Kepler

[57] ABSTRACT

A liner fastener arrangement for retaining a liner including bags with or without handles. The liner fasteners are retained relative to the container for providing removable liners.

7 Claims, 19 Drawing Sheets

FASTENING DEVICE FOR CONTAINER LINERS

RELATED APPLICATIONS

This is a division of Ser. No. 07/858,684, filed Mar. 27, 1992 and issued as U.S. Pat. No. 5,261,553 on Nov. 16, 1993, which is a continuation-in-part of Ser. No. 07/542,815, filed Jun. 25, 1990 and issued as U.S. Pat. No. 5,100,087 on Mar. 31, 1992, which is a continuation of Ser. No. 319,044, Mar. 6, 1989, now abandoned, which is a continuation of Ser. No. 07/141,546, filed on Jan. 7, 1988, now abandoned.

BACKGROUND OF THE INVENTION

This invention relates to trash containers which may be lined with plastic bags, in particular plastic bags with handles and pertains, more particularly, to holding a flexible plastic container liner in place generally around the rim of a trash container.

DESCRIPTION OF PRIOR ART

Many consumers prefer to line their trash containers with the bags they bring home their purchases in. In recent years, stores have switched from paper bags to limp, non-supporting, flexible plastic bags, typically with handles. These bags have a tendency to slip off the rim of the trash container and fall closed in the bottom. This is one significant drawback to the re-use of these flexible bags which would otherwise be thrown away.

Many efforts have been made to support these bags in an open manner to facilitate their use for trash disposal. In Isgar (U.S. Pat. No. 4,576,310) there is disclosed a container with two sets of cooperating hooks and notches. One problem associated with Isgar is that the bag is held across the mouth of the container instead of around the rim, allowing trash to fall down between the wall of the container and the bag. Isgar is also suited for use with only one size of handled plastic bag. Ferron (U.S. Pat. No. 4,445,658) discloses a fixed rim with downwardly protruding rods. Ferron is also suited for use with only one size of plastic bag with handles.

Additional efforts to solve this and related problems have focused on the use handled plastic bags, for example, co-pending allowed patent application, Ser. No. 542,815, filed Jun. 25, 1990, which is a continuation of Ser. No. 319,044, filed Mar. 6, 1989, which is a continuation of Ser. No. 141,546, filed Jan. 7, 1988.

The allowed co-pending application teaches a means of gripping a bag handle to an exterior side of the container, whereby the mouth of the bag is maintained in position around the rim of the container. However, there may be drawbacks associated with the invention disclosed in the allowed application, for example, it is thought that the container in the allowed application will function best when used with liners with a handle or handle-like opening. There are believed to be numerous liners which do not include the handle or handle-like opening.

A drawback associated with other attempts to solve the present problem is illustrated by the use a liner wherein the mouth of the liner is tightened around the rim of the container by twisting an edge of the bag/-liner. This twisting forms an ear that may be placed in a receiving opening provided. The drawback associated with this approach to the problem is that the ear tends to work loose from the notch, thereby allowing the mouth of the liner to slip off the rim of the container.

OBJECTS AND ADVANTAGES

One main object, therefore, of the present invention is to provide a device which will secure plastic bags with handles in place around the rim of a trash container and facilitate the use of plastic bags of different sizes. Further objects and advantages will become apparent from a consideration of the ensuing description and accompanying drawings.

Another object of the present invention is to provide a device which will hold open the mouth of a handled plastic bag to facilitate its being filled with a product.

A further object of the present invention is to provide a simple and efficient means of maintaining both handled and non-handled bags and liners in place around the rim of a container.

SUMMARY OF THE INVENTION

To accomplish the foregoing and other objects of this invention there is provided a fastening device for container liners for fastening generally flexible bags and liners around the rim of a container.

The fastening device comprises a variety of embodiments including means for snapping the liner between two members, clipping the liner to a rim of the container, or providing an improved insert for receiving a portion of the liner.

The fastening devise of the present invention is preferably adapted for use with trash containers in which plastic bags, with or without handles, are used for liners. The bags are flexible and readily used as liners. The present invention is adaptable to any type of bag or liner equivalent to the plastic grocery bags presently in use. For example, new biodegradable products, such as corn starch based flexible material, will most likely be available in the near future. The present invention will function with this material as well as any other similar material.

These and other objects and features of the present invention will be better understood and appreciated from the following detailed description of a plurality of embodiments thereof, selected for purposes of illustration and shown in the accompanying drawings.

DRAWING FIGURES

DRAWING REFERENCE NUMERALS

Figure 1:
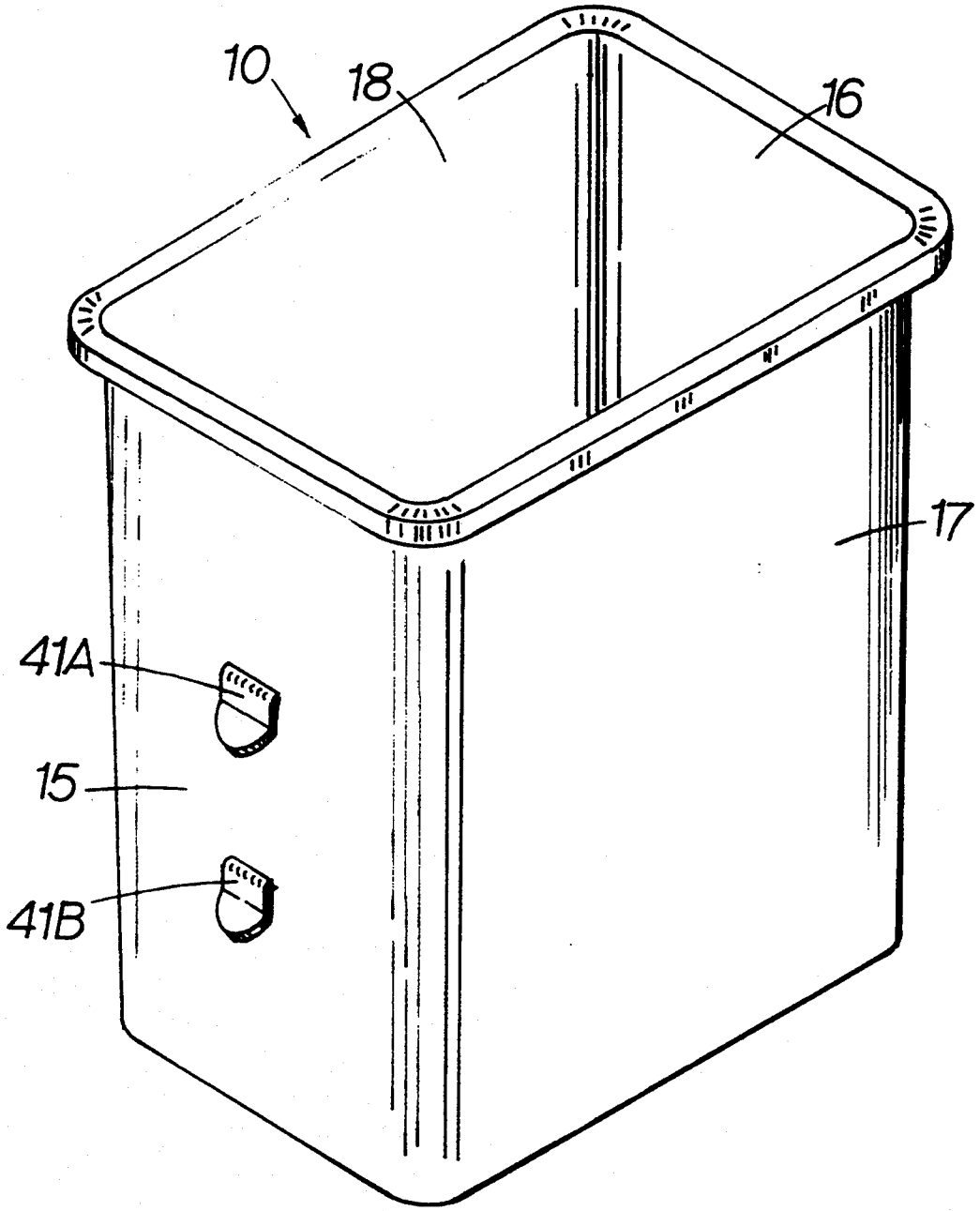
FIG. 1 shows a perspective back elevational view of a trash container manufactured with the fastening device.

7. Bag filling stands
10. trash container
15. short container side
16. short container side
17. long container side
18. long container side
41. fastening device
43. parallel section of fastening device
44. nubbin underneath parallel section
45. angled section of fastening device
50. plastic bag with handles
51. bag handle

DESCRIPTION

Figure 2:
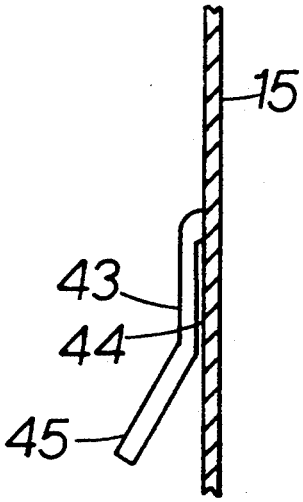
FIG. 2 shows a side view of the preferred embodiment of the fastening device.
Figure 3:
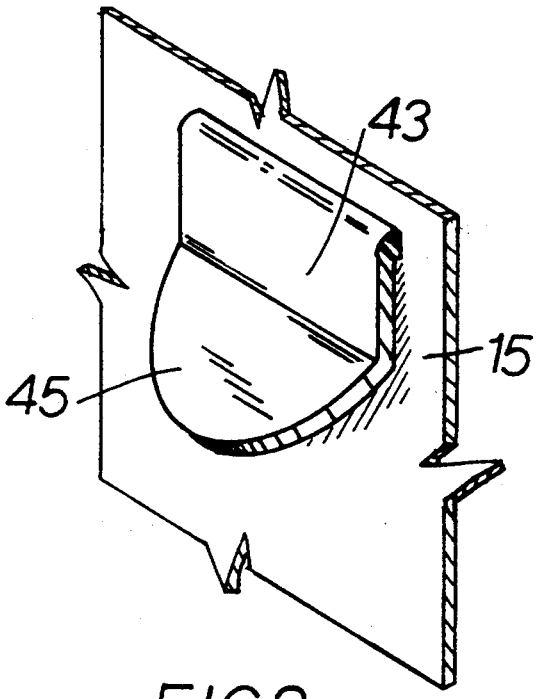
FIG. 3 shows a perspective view of the preferred embodiment of the fastening device.

FIG. 1 shows a trash container 10 manufactured with the fastening device. The trash container is of rectangular shape, having two short sides, 15, 16, and two long sides, 17 and 18. Molded onto the exterior of side 15 are a series of fastening devices 41*a* 41*b*. As best shown in FIG. 2 and 3 the fastening device extends downward, having a part 43 which is closely situated to and parallel to the container wall, and a lower part 45 which angles away from the container wall. Situated on the underneath of the parallel part 43 is a nubbin 44 which comes in contact with the container wall.

SECURING DEVICE—OPERATION

Figure 4:
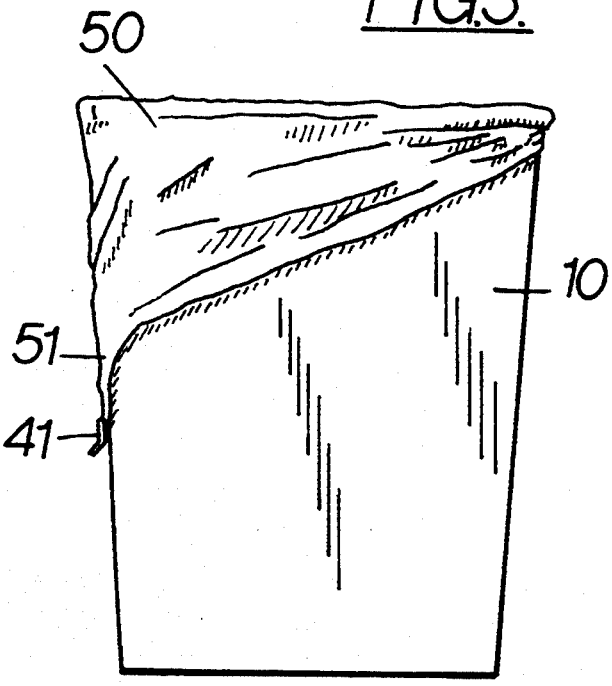
FIG. 4 shows a side view of a trash container manufactured with a single fastening device lined with a handled plastic bag.

In the preferred embodiment of the invention, shown in FIG. 4, the body of plastic bag 50 is inserted into container 10, which is manufactured with a fastening device on one side. The mouth of the bag is then pulled out over the rim of the container. One bag handle 51 is grasped and pulled downward until the other side of the bag is pulled tight against the rim of the container. The bag handle 51 is then placed in the fastening device 41 and pulled upwards until it rests in the crook of the fastening device. The bag handle forces the tab of the fastener away from the side of the container, the resulting tension working with the nubbin to hold the bag handle in place. Thus the bag handle is actively fastened to the side of the container and the mouth of the bag is held in place around the container rim.

Figure 5:
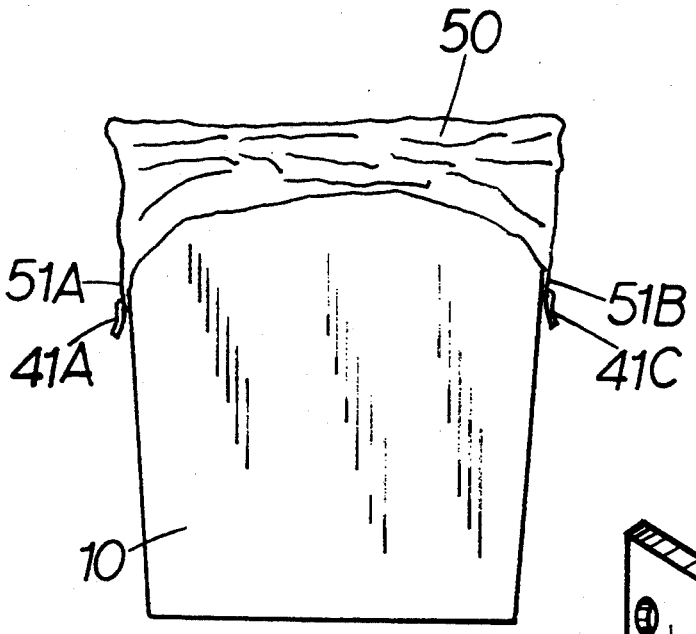
FIG. 5 shows a side view of a trash container manufactured with fastening devices on both sides lined with a handled plastic bag.
Figure 6:
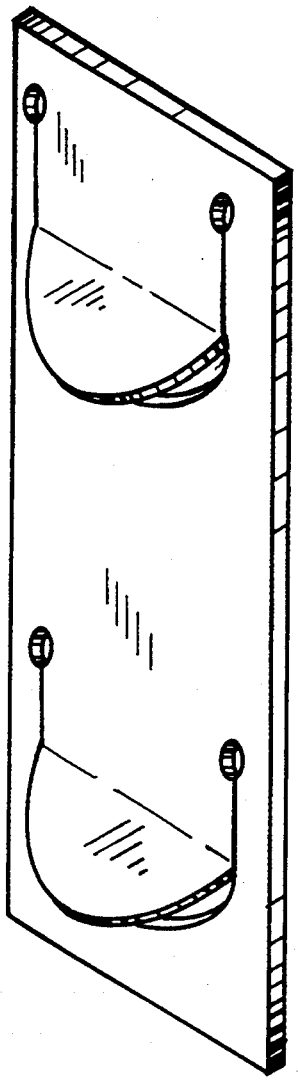
FIG. 6 shows a perspective view of a fastening device which may be added to existing containers.
Figure 7:
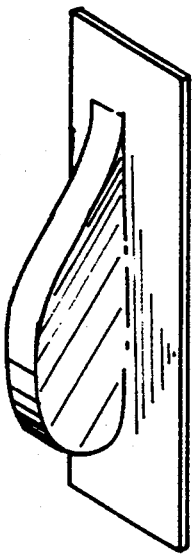
FIG. 7 shows a perspective view of an embodiment of the fastening device comprising a flat tab with a downwardly facing opening.
Figure 8:
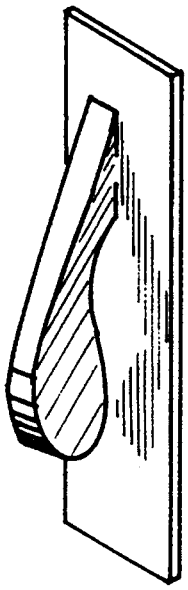
FIG. 8 shows a perspective view of a fastening device comprising a clip-like projection.
Figure 9:
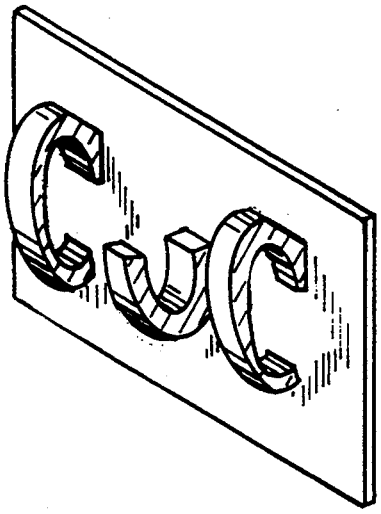
FIG. 9 shows a perspective view of an additional embodiment of the fastening device comprising three incurvate tabs.
Figure 10:
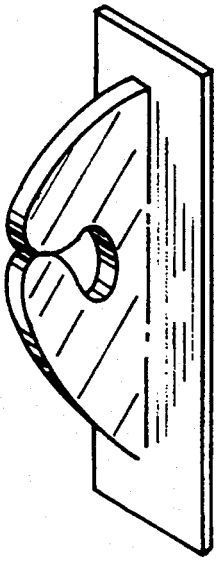
FIG. 10 shows a perspective view of a fastening device comprising a tab with a pincher-like opening.
Figure 11:
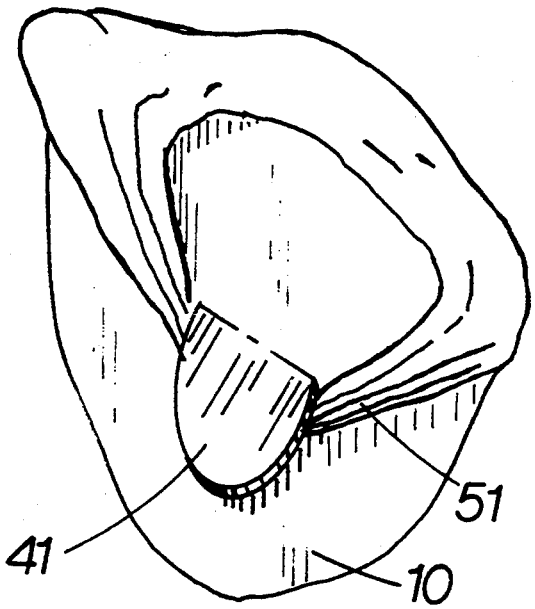
FIG. 11 shows a closeup of a bag handle secured by a fastener of the present invention.
Figure 12:
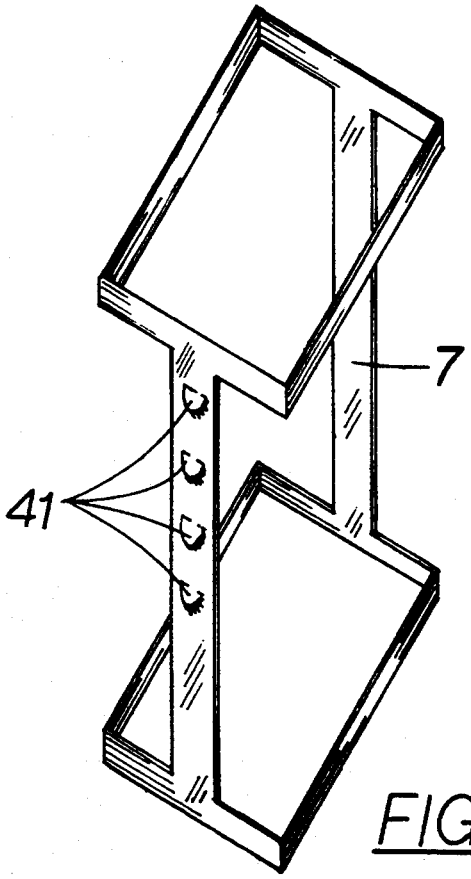
FIG. 12 shows a perspective view of a bag filling stand incorporating the fastening device.
Figure 13:
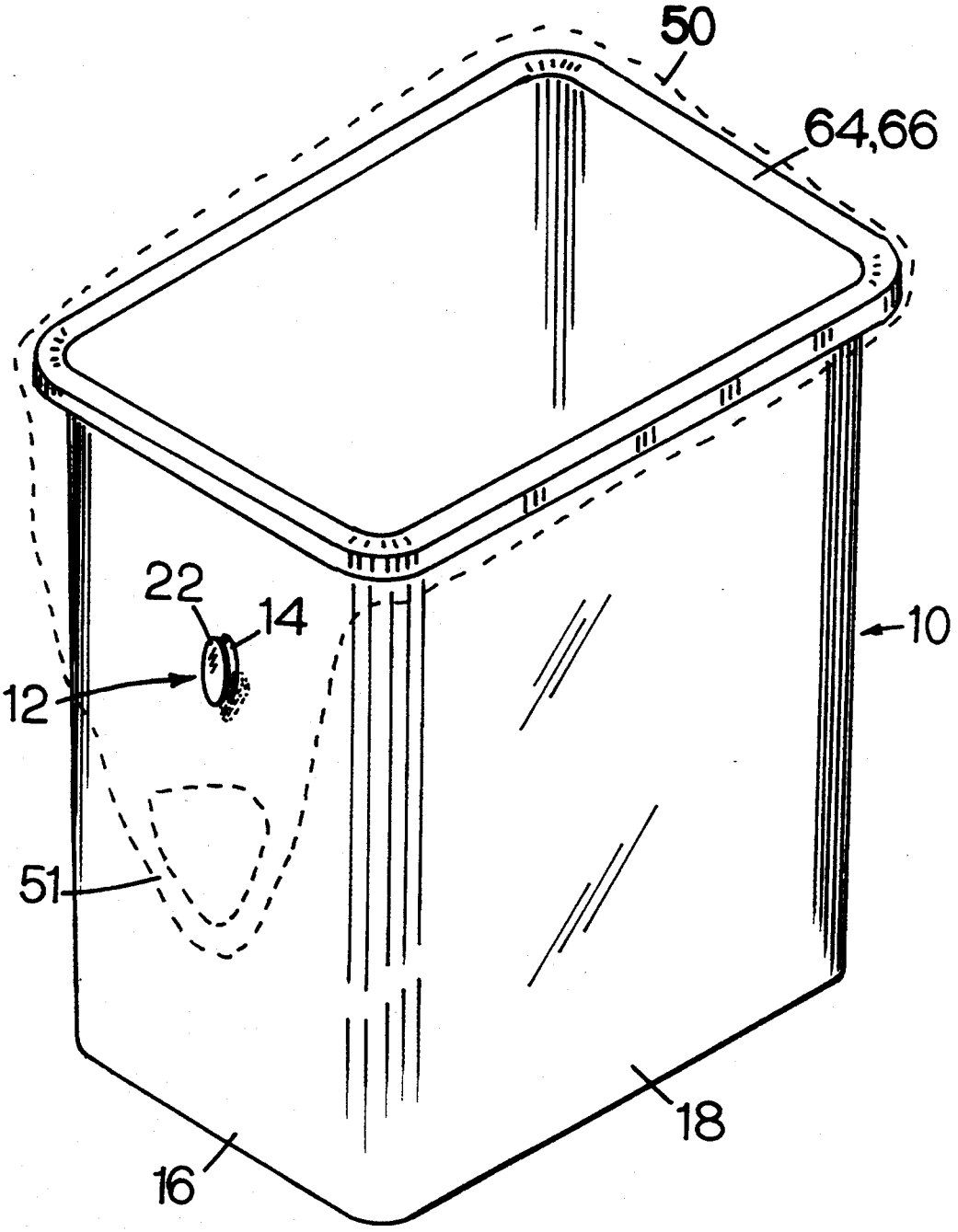
FIG. 13 is a perspective view of an improved container constructed in accordance with the present invention depicting a snap-type fastener arrangement.
Figure 14:
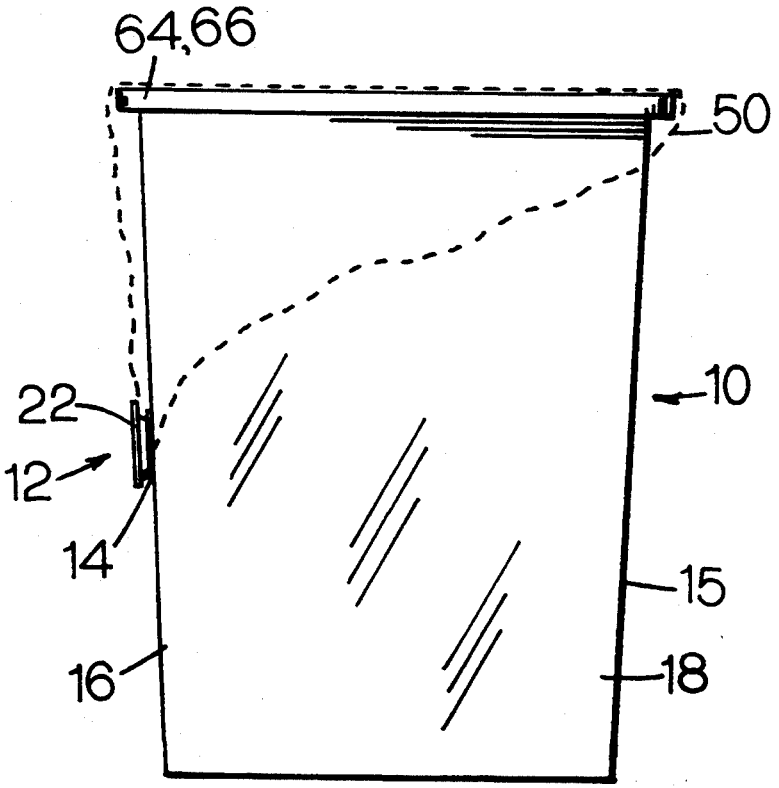
FIG. 14 is a side view of the container depicted in FIG. 13.
Figure 15:
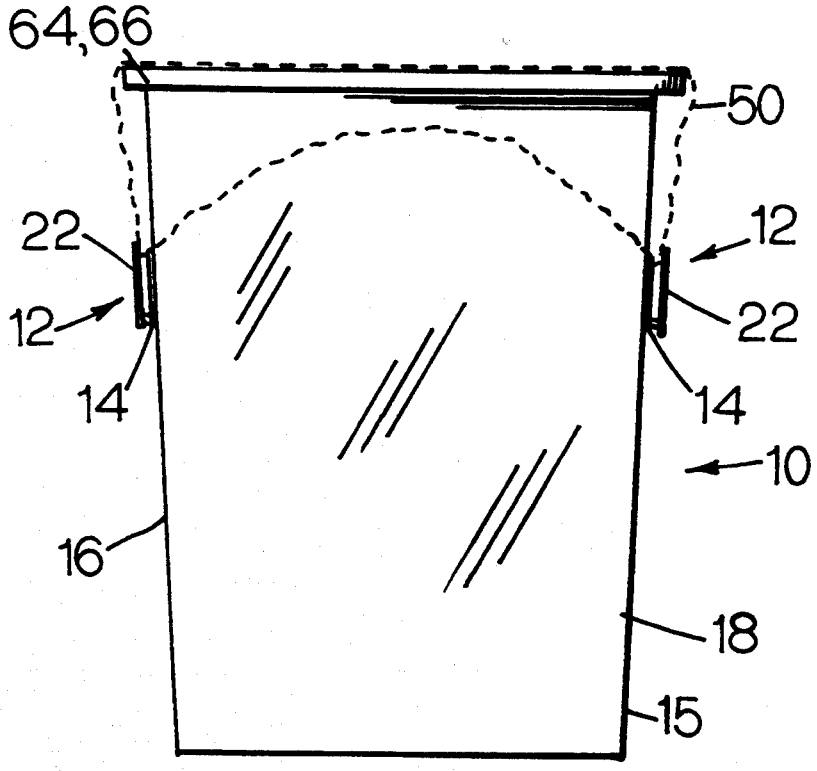
FIG. 15 is a side view of a variation of the container depicted in FIG. 13.
Figure 17:
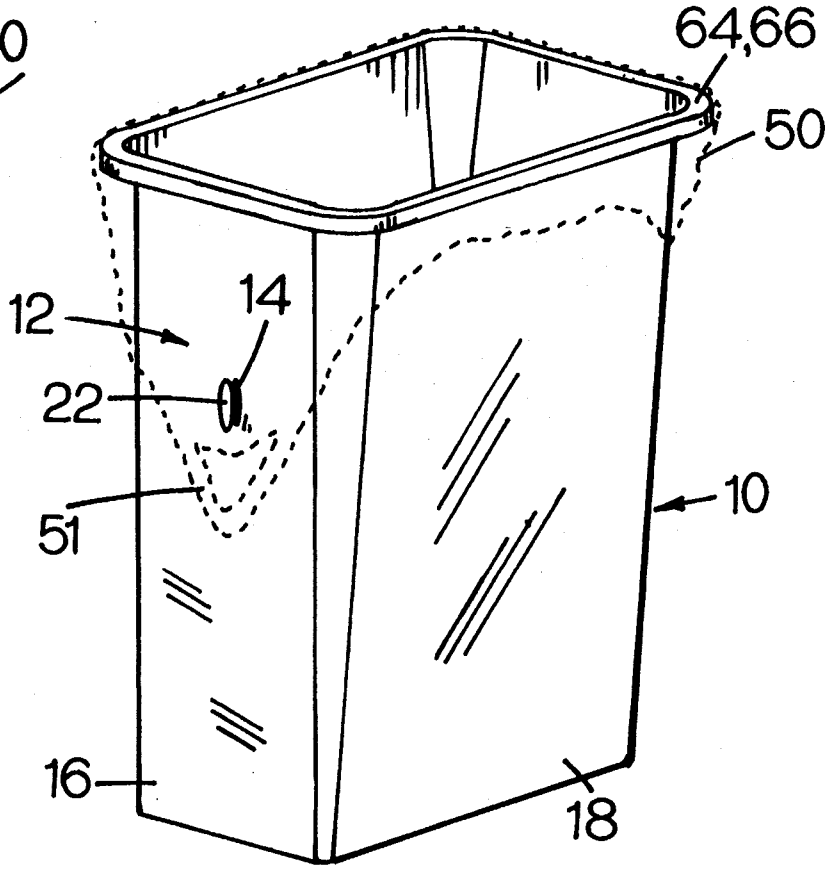
FIG. 17 is a perspective view similar to FIG. 16 and illustrates another arrangement for retaining a bag or liner which has a handle.
Figure 16:
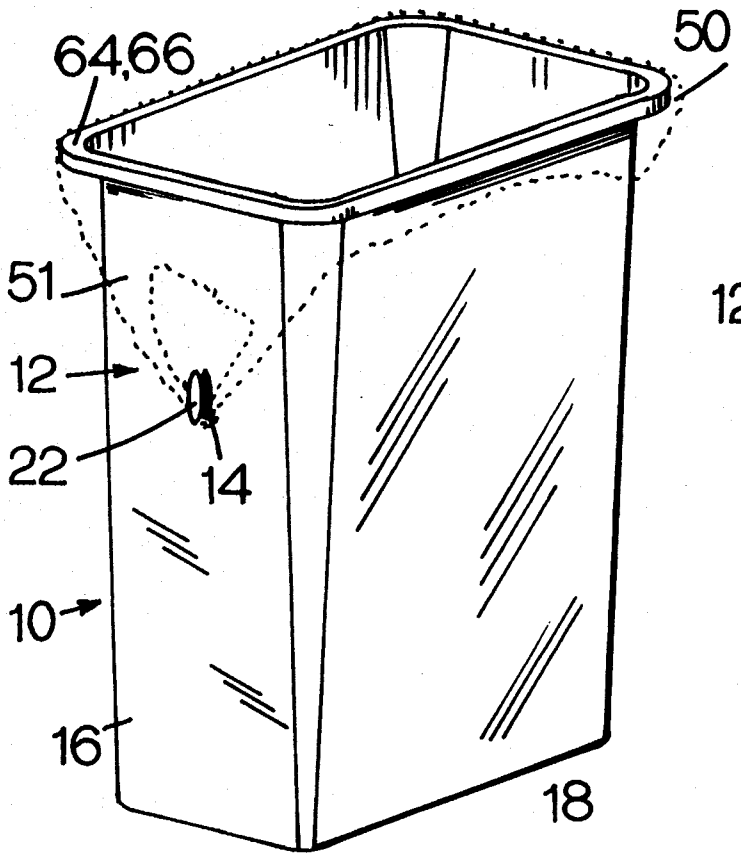
FIG. 16 is another perspective view of the improved container depicted in FIG. 13 in which a bag with a handle is illustrated in use with an embodiment of the present invention.
Figure 18:
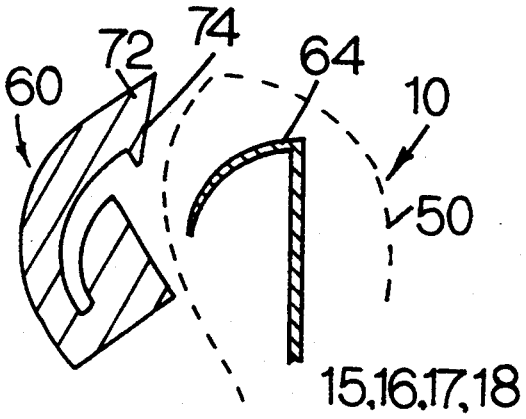
FIG. 18 is a cut-away view of a retaining clip fastener of the present invention relative to a container rim and liner.
Figure 19:
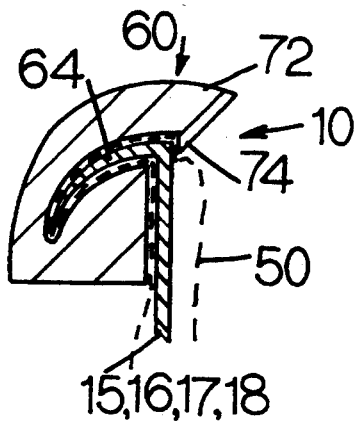
FIG. 19 is another cut-away view of the retainer clip fastener depicted in FIG. 18 engaged with the container rim and retaining the liner or bag.
Figure 20:
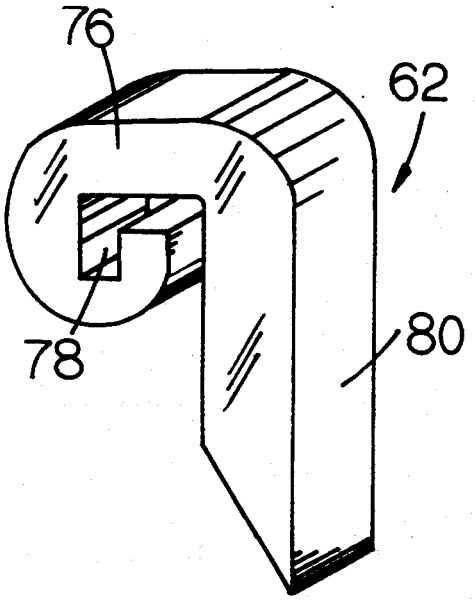
FIG. 20 is a perspective view of another retainer clip fastener in accordance with the present invention.
Figure 21:
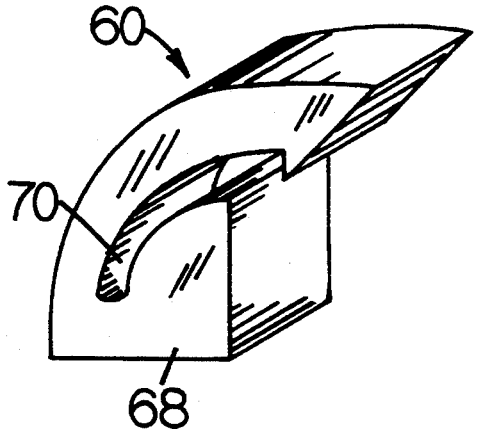
FIG. 21 is a perspective view of the retainer clip fastener depicted in FIGS. 18 and 19.
Figure 22:
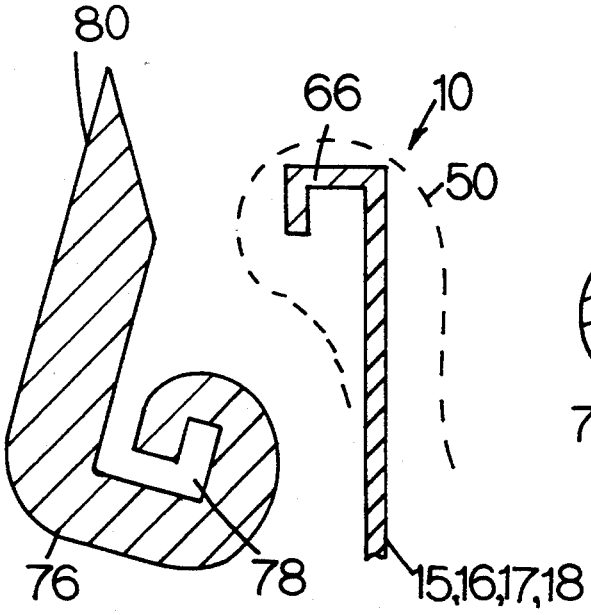
FIGS. 22 through 26 is a series of cut-away views of the retainer clip fastener depicted in FIG. 20 illustrating its use with a container rim.
Figure 23:
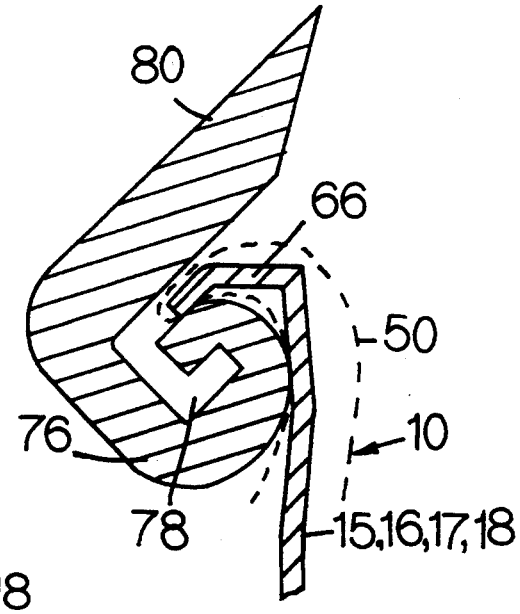
Figure 24:
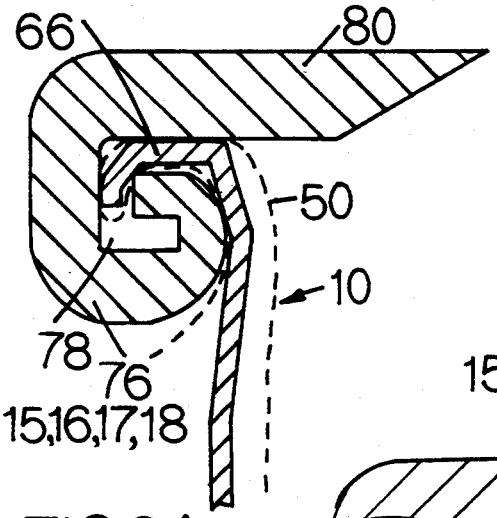
Figure 25:
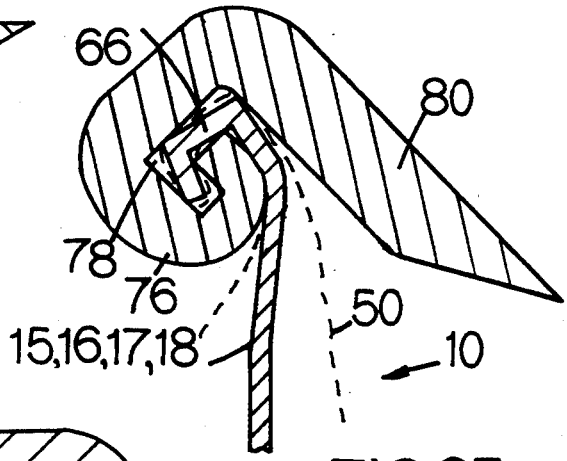
Figure 26:
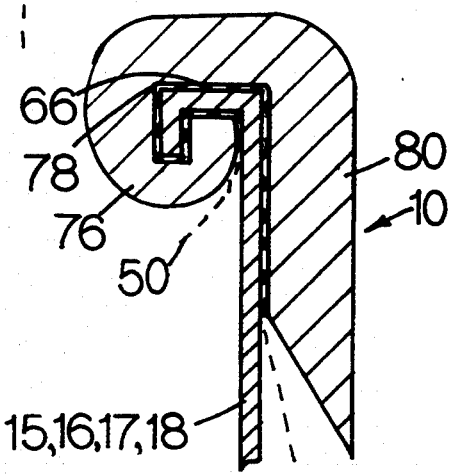

In another preferred embodiment of the invention, shown in FIG. 5, the body of plastic bag 50 is inserted in container 10, which is manufactured with two fastening devices 41*a* 41*c* on opposite sides of the container. The bag handles 51*a* 51*b* are then grasped and pulled downward until the mouth of the bag is pulled out over the rim of the container. The bag handles are then placed in the fastening devices and pulled upward until they rest in the crook of the fastening device. The bag handles force the tabs away from the sides of the container, the resulting tension working with the nubbin to hold the bag handle in place. In this manner the bag handles are fastened to the sides of the container and the mouth of the bag is held in place around the rim of the container.

In another preferred embodiment of the invention a bag filling stand 7 may be provided in the shape illustrated or other suitable shapes, and also have but a single fastener. It will be understood that the bag filling stand may also be used in conjunction with a scale (not shown) to allow a product to be weighed as it is placed in the bag.

Referring again to the drawings, FIGS. 13 through 52, there is shown preferred embodiments of the fasteners of the present invention, and particularly drawing FIGS. 13 through 17 illustrate a container with a liner or bag with or without handles.

A trash container 10 is includes means for snapping a liner in place relative the container. The typical container, particularly a trash container, includes wider sides 17, 18 and narrower sides 15, 16. A base member 14 of the fastener 12 is attached to or through the associated container side as will be described in more detail below. The fastener could be attached to any of the container sides and function as desired.

A projection means 20 extends from the base member 14 and is received by a cover 22 in an opening defined by a wall member 24. The drawing figures illustrate the snap-type fastener on one side of the container and on both sides of the container. The drawing figures also depict the use of the present invention with a liner or bag 50 with and without a handle portion 51.

Figure 27:
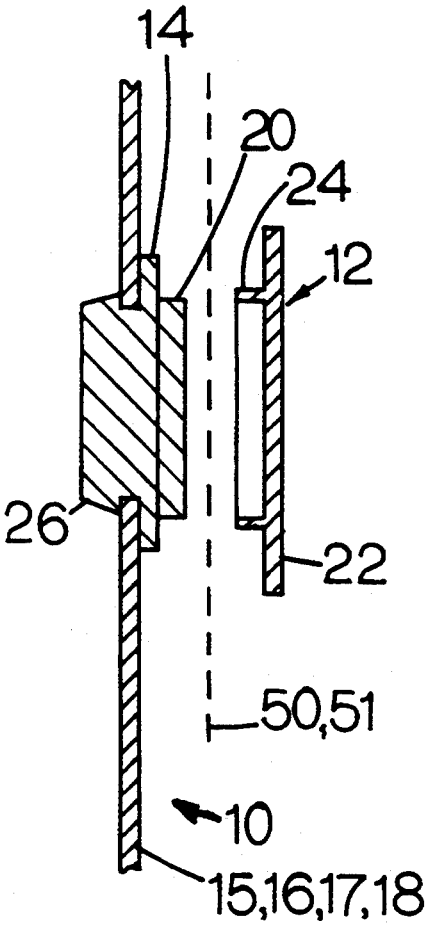
FIG. 27 is a cut-away view of a snap-type fastener constructed in accordance with the present invention to show the snap-type fastener construction.
Figure 28:
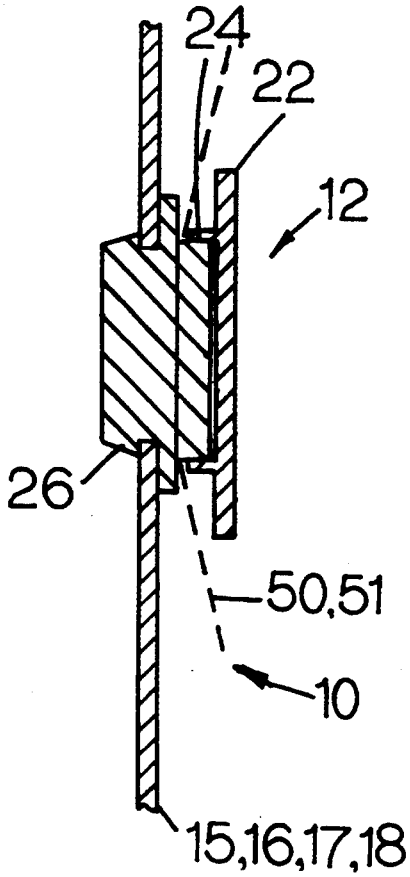
FIG. 28 is another view showing the snap-type fastener in use retaining a liner.
Figure 29:
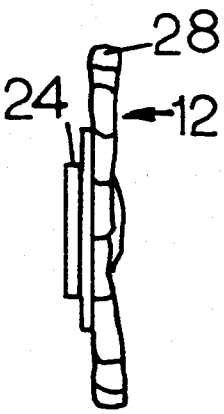
FIG. 29 is a side view showing a decorative embodiment of the snap-type fastener.
Figure 30:
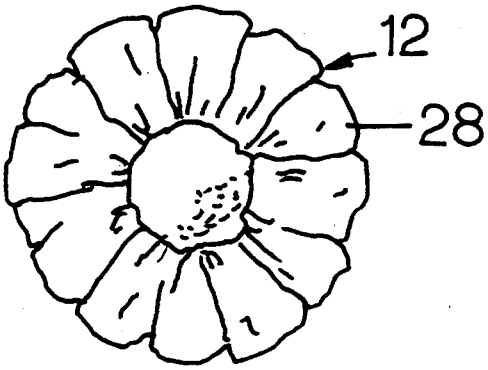
FIG. 30 is an elevation view showing an illustrative embodiment of the decorative snap-type fastener.
Figure 31:
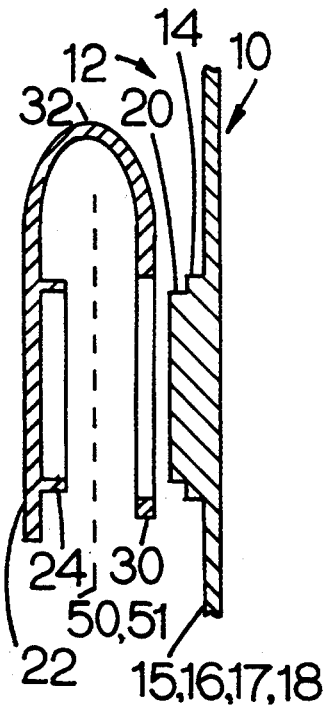
FIGS. 31 through 35 are cut-away views of another embodiment of the snap-type fastener including a retention loop or strap.
Figure 32:
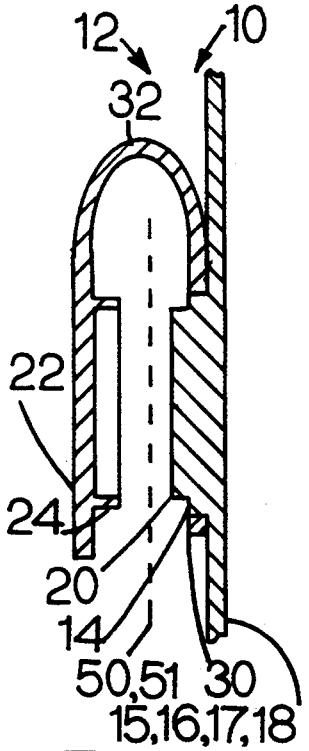
Figure 33:
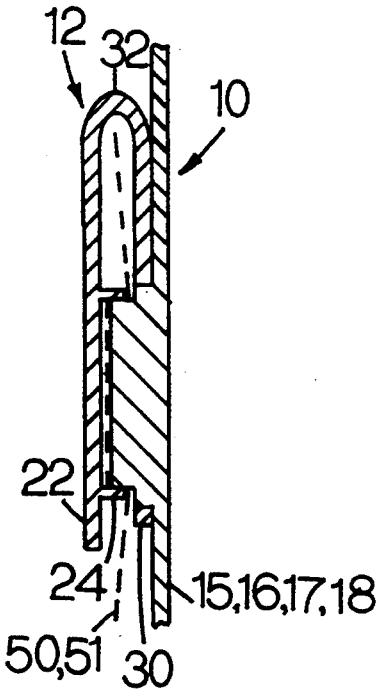
Figure 34:
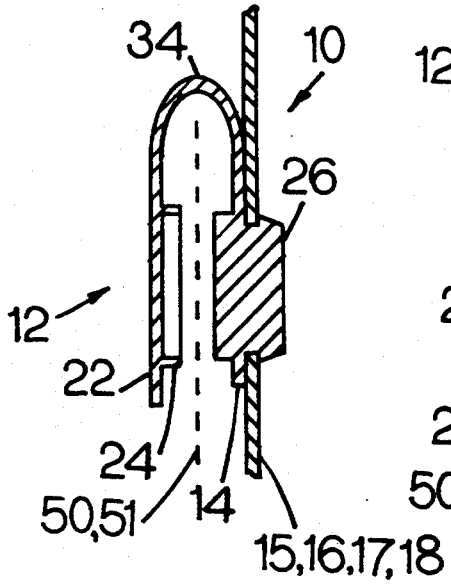
Figure 35:
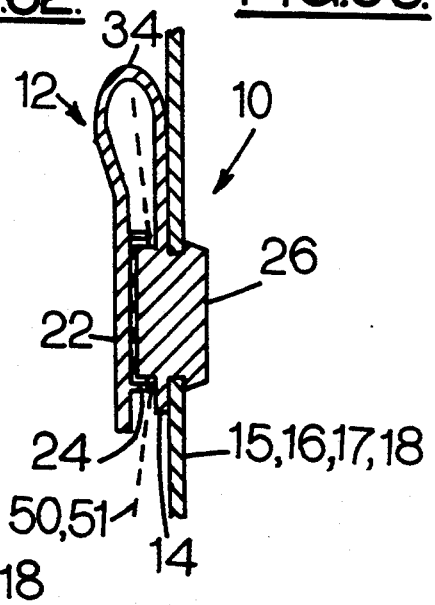

The fastener 12 can be attached to the container in a variety of fashions. The base 14 can have an adhesive backing or a projection 26 forced through and held in a receiving opening in the container as illustrated in FIGS. 27 and 28. The cover member 22 can be provided with or formed with a decorative cover 28 such as the flower depicted in FIG. 30.

In order to keep from losing the cover member 22, the fastener can be equipped with a retaining portion or ring 30 connected by a strap member 34 to the cover member 22. The retaining ring and strap combination is depicted for purposes of illustration in FIGS. 31 through 33. In another embodiment, depicted in FIGS. 34 and 35 there is a strap 34 that can be an extension of the base portion 14 of the fastener 12.

Figure 36:
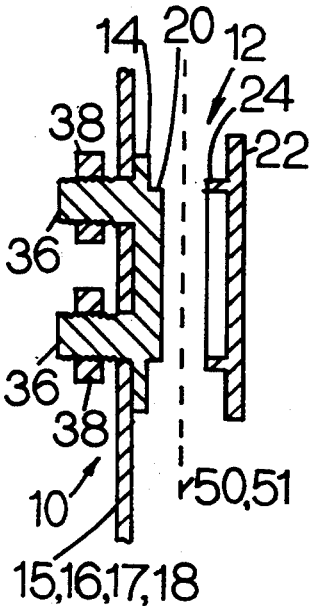
FIGS. 36 through 38 are cut-away views of another embodiment of the snap-type fastener depicting container attachment variations.
Figure 37:
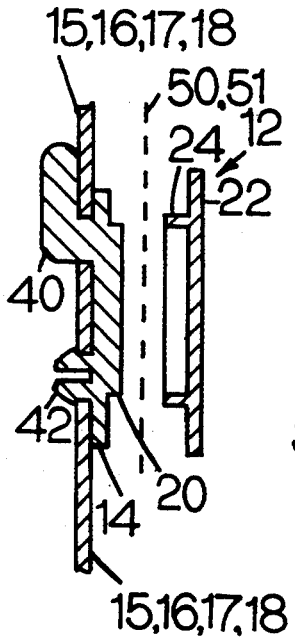
Figure 38:
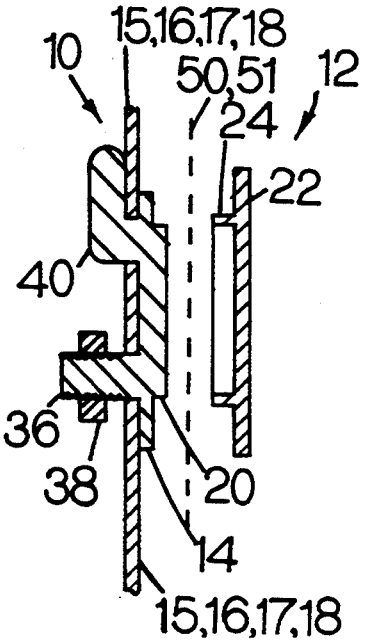
Figure 41:
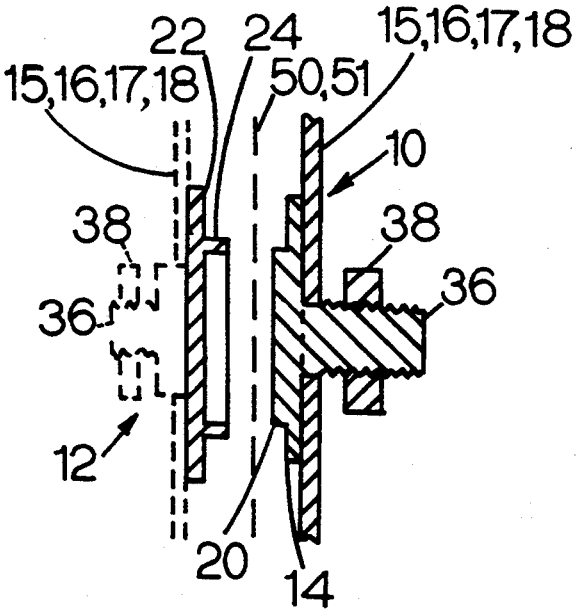
FIGS. 41 through 44 are cut-away views of variations of the snap-type fastener of the present invention.

Referring now to FIGS. 36 through 38, there is depicted means for connecting the fastener 12 to the container wall or walls. In FIGS. 36 and 41 holes are provided in the container wall for receiving one or more threaded extensions 36 and associated nut(s) 38 for retention of the base member of the fastener.

It will be understood that the combination of fastening schemes is numerous. A few will be describe for purposes of illustration. FIG. 37 depicts a combination of a compressible rivet extension 42 and a hook 40. The hook 40 is similar in shape and function to any of the hooks typically used with pegboard.

Figure 39:
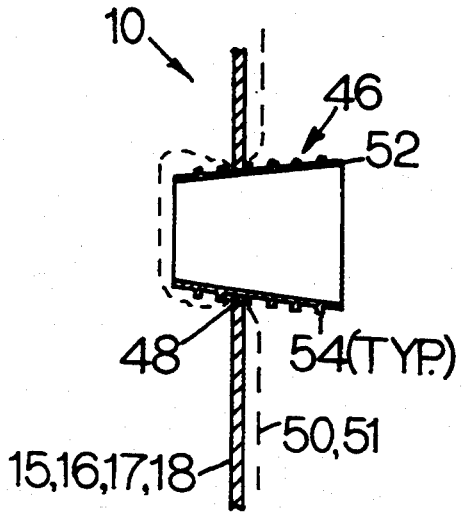
FIGS. 39 and 40 are cut-away views of another embodiment of the fastener of the present invention for retaining a container liner.
Figure 40:
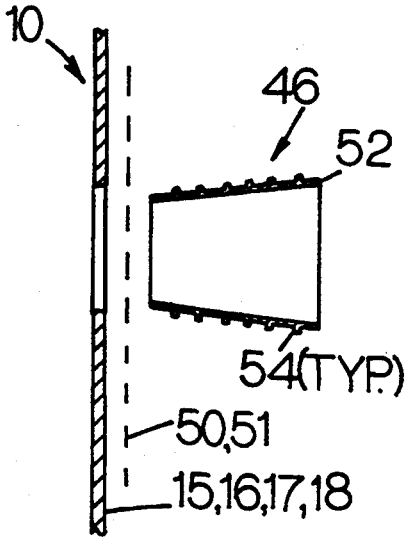

Another variation of the present invention is illustrated in FIGS. 39 and 40. A plug-type liner fastener 46 engages a opening 48 defined by one or more of the container side walls. A plug member 50 is preferably manufactured with one or more projections 54. The projections assist to retain the plug in place and hold the liner 50 with or without handles 51.

Figure 42:
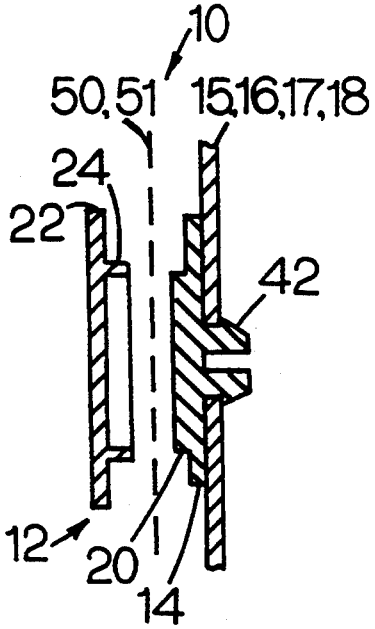
Figure 43:
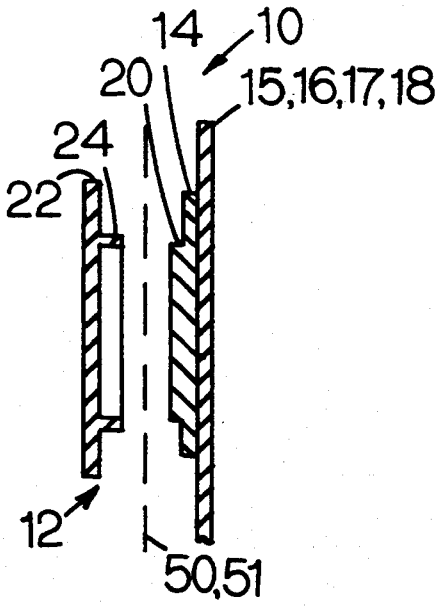

FIG. 41 illustrates that the cover member 12 can be attached to the container 10. Similarly, the other combinations, both shown and not shown, can be adapted as suggested in FIG. 41. FIG. 42 illustrates a single rivet 42 embodiment and FIG. 43 depicts an embodiment in which the base 14 is attached by suitable adhesive intermediate the base and the wall 15, 16, 17, and/or 18 or container 10.

Figure 44:
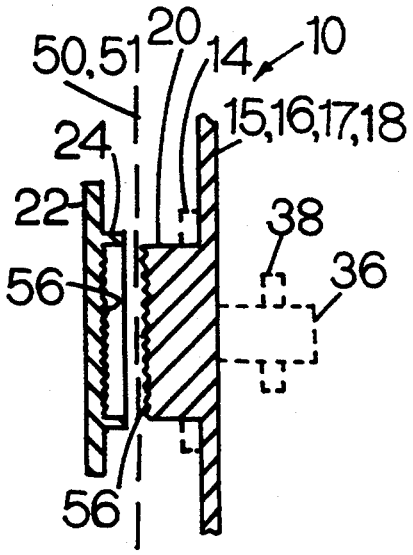
Figure 45:
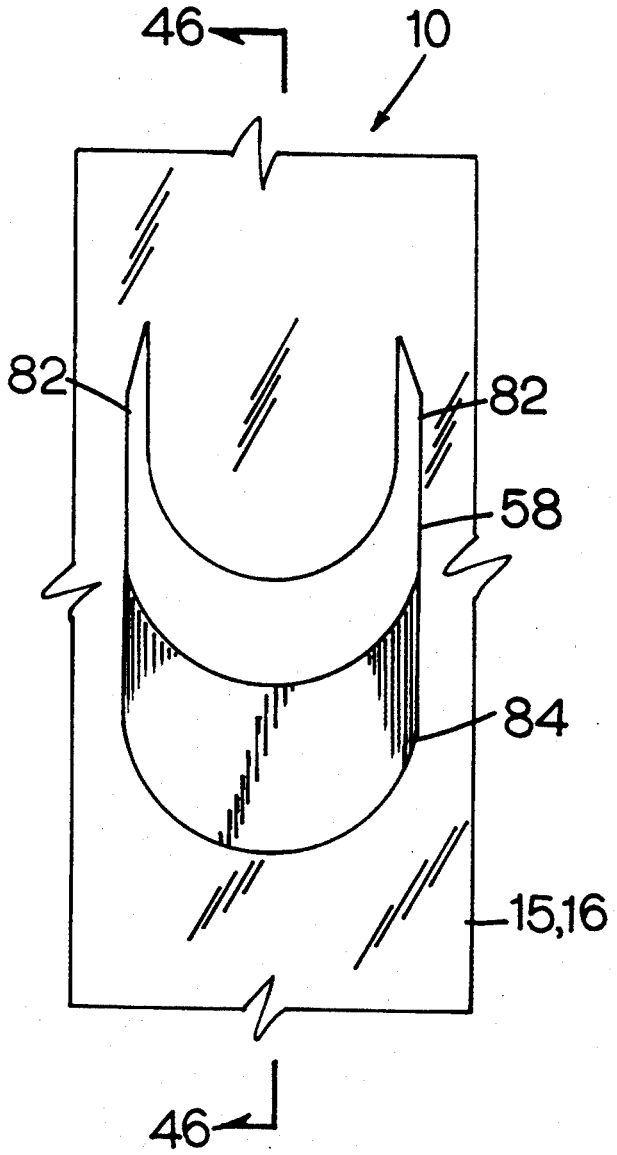
FIGS. 45 through 52 illustrate a cut-out variation of the liner retainer construction of the present invention.
Figure 46:
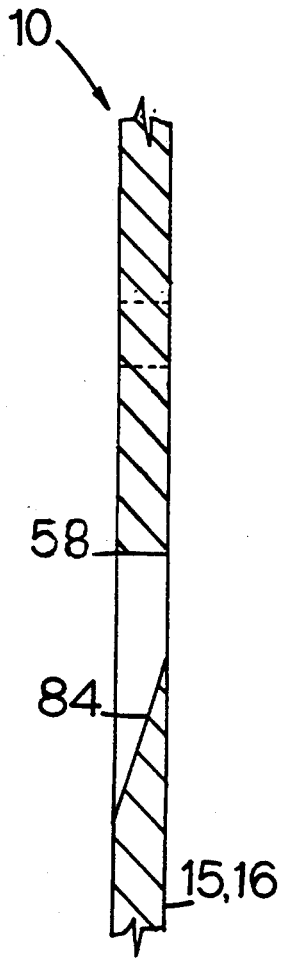
Figure 47:
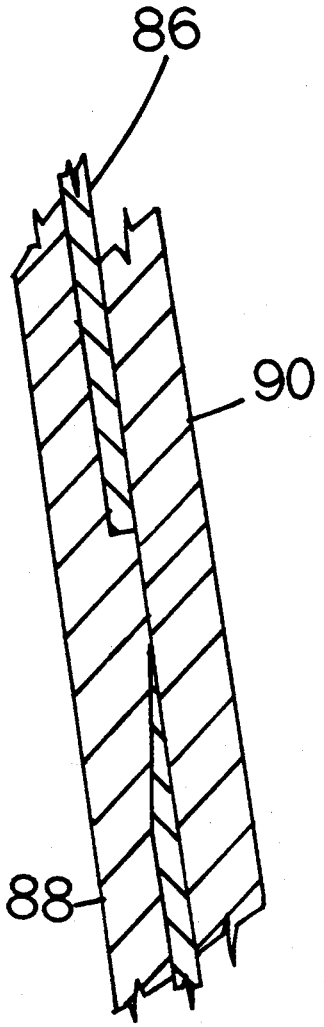
Figure 48:
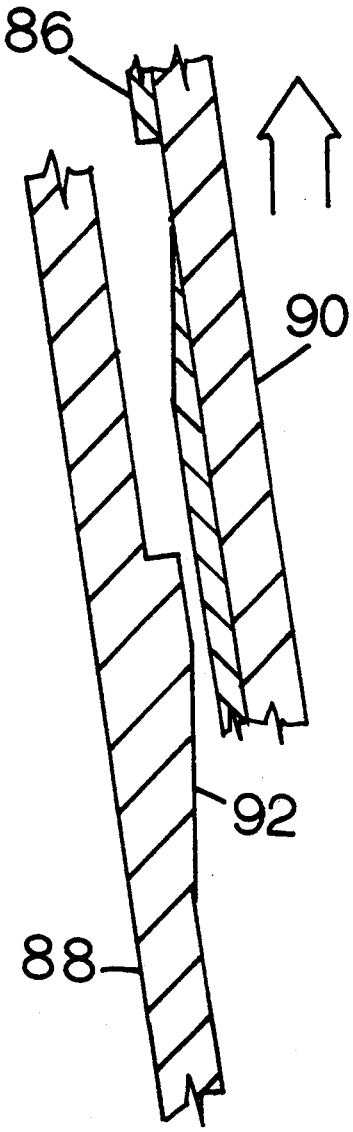
Figure 49:
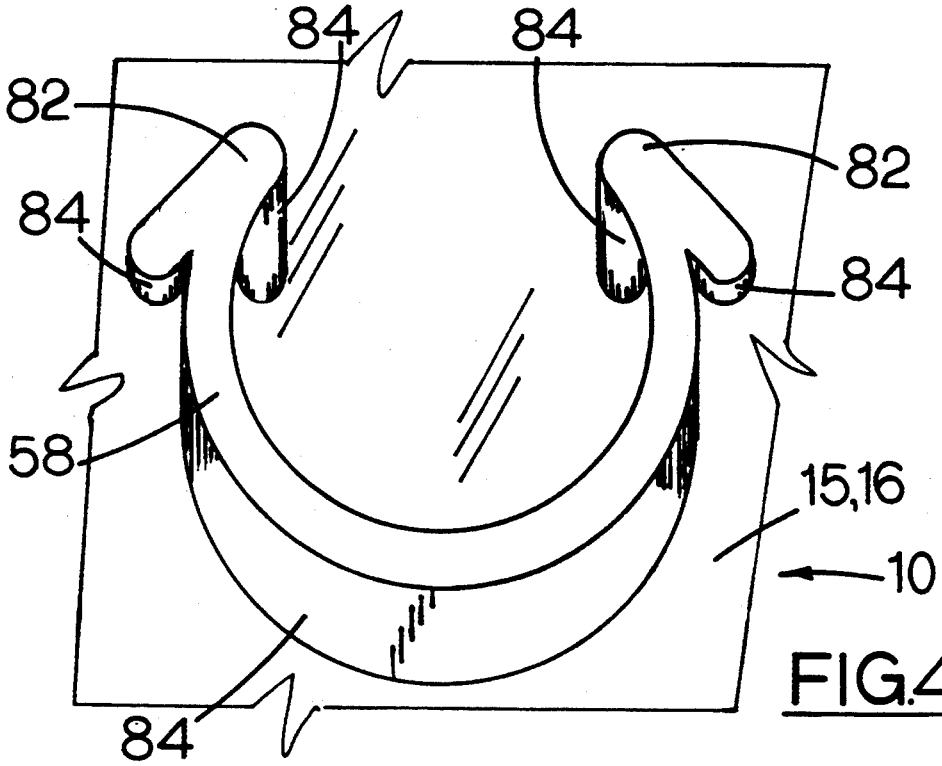
Figure 50:
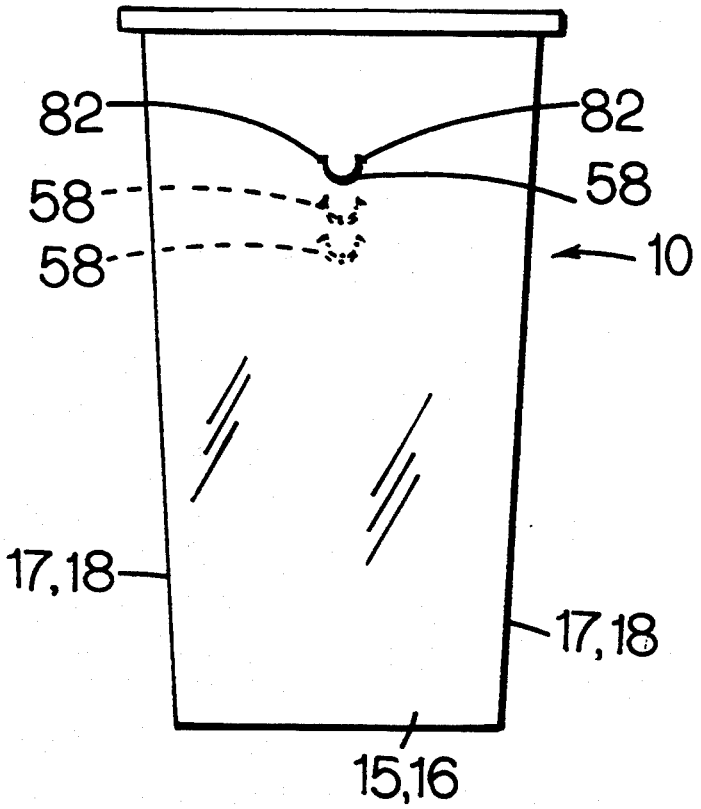
Figure 51:
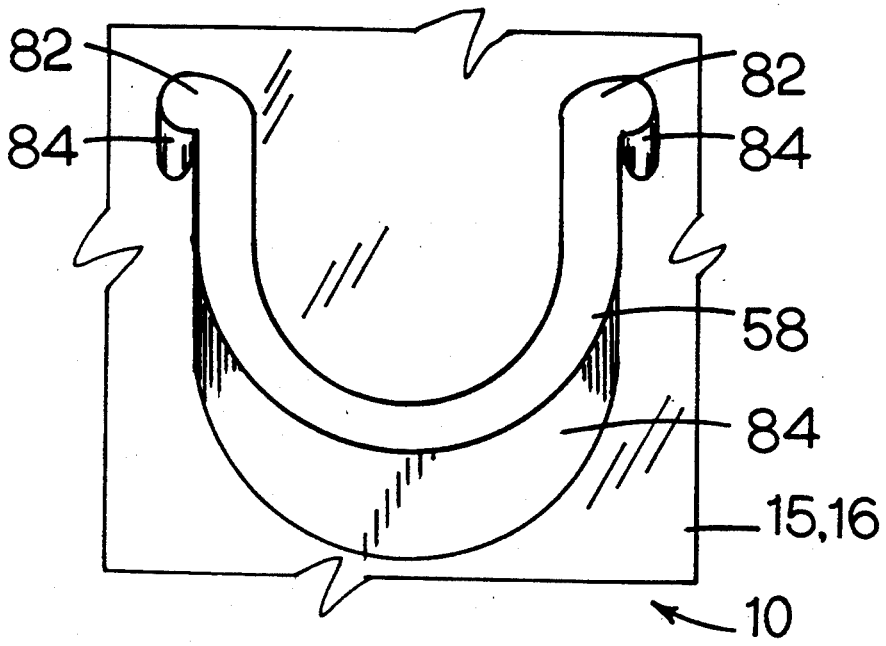
Figure 52:
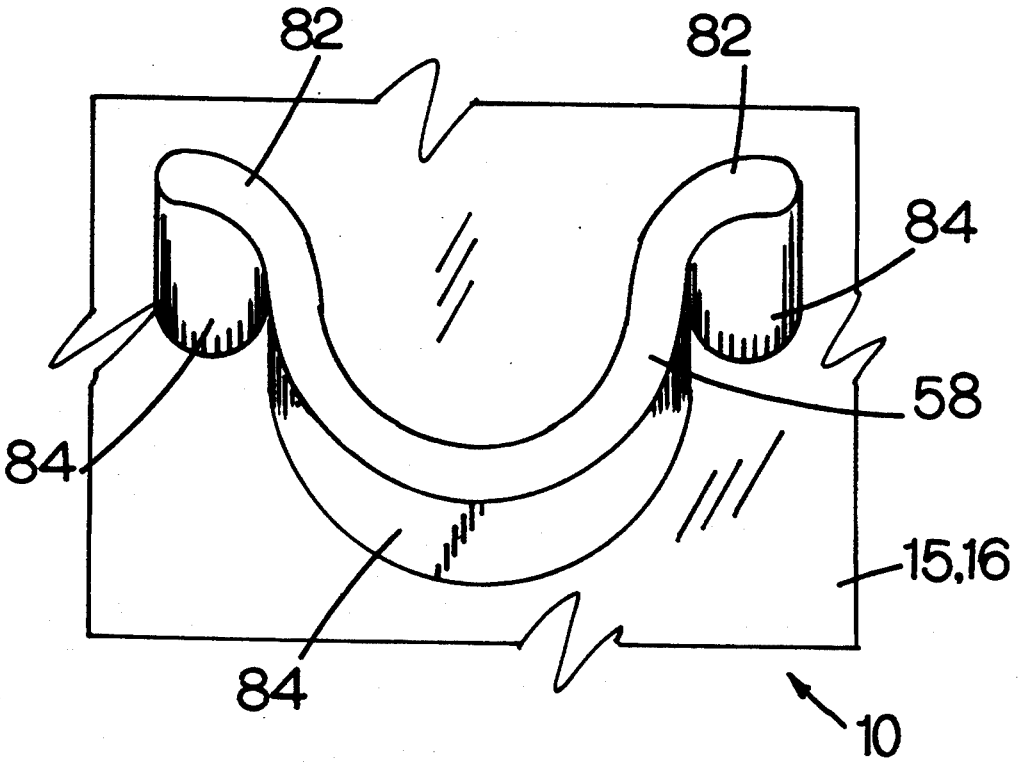

In the embodiment depicted in FIG. 44 it is understood that the liner may be hard to grasp and hold in place and the fasteners could be adapted by adding a friction surface 56 to both or either of the cover 12 and base member.

Referring now to FIGS. 18 through 26 there is shown two clip-type fasteners 60 and 62 that hold the liner 50, 51 to a curved rim embodiment 64 and a squared rim embodiment 66, respectively.

Clip member 60 includes a body portion 68 and a rim receiving groove 70. A hook portion 72 goes over the rim and a hook projection 74 assists to hold the clip in place over the rim and, therefore, the liner in place as well. Operation of the clip 60 will be understood from the sequence FIGS. 18 and 19. Removal of the clip is the reverse of the illustrated sequence.

Clip member 62 includes a body portion 76 and rim receiving groove 78. A leg portion 80 extends down the side of the container opposite the rim extension to assist to hold the clip in place along with the right angles of the groove 78. Operation of the clip 62 will be understood from the sequence of FIGS. 22 through 26. Removal of the clip 62 is accomplished by reversing the sequence.

The clip members can be used one at a time or in multiples as desired.

In another embodiment of the present invention, illustrated in FIGS. 45 through 52, liner receiving opening or openings 58 are provided without extensions or projections from the outside surface of the container 10. In the illustrated embodiment a slot or slots 82 extend upward from the main opening 58. A beveled surface or surfaces 84 is provided by a container mold 88 when a molded container 86 and mold core 90 are removed from the mold. The beveled portion 92 of the mold form the bevel 84 and allows molding the container with the liner receiving opening 58.

The trash container 10 has opposing short or narrower sides 15 and 16 suitable for receiving the opening or openings 58 for securing a plastic bag with handles 50 (not shown). The generally upright side portions 15, 16, 17 and 18 terminate in a substantially upright rim portion which defines the container mouth.

The fastener of the presently described embodiment is generally defined by one or more of the cutouts or openings 58 in the side of the trash container 10. This fastener and cutout combination cooperate to grip a handle of the plastic bag.

As previously described the plastic bags described herein have at least one handle and mouth. The bag handles and the mouth of the bag are situated on the external or outside of the trash container sides and rim, respectively.

The combined fastener and cutout are placed in the side walls of the trash container a sufficient distance below the trash container's rim in order to pull the plastic bag and its handles against the opposite sides of the trash container. In effect, the present invention increases the effective circumference of the mouth of the trash container.

In other words, by pulling the mouth of the plastic bag against the opposite external or outside portions of opposing sides of the trash container, the plastic bag is held with its handles in the particular opposing openings 58 and the mouth of the plastic bag is fully opened. The mouth of the plastic bag is now pulled from the tension of the handles in their respective openings against the outside of the trash container with the opening portion of the trash bag inside the mouth of the trash container held against the inside or internal facing surfaces of the trash container.

Thus, the mouth of the plastic bag is held around the rim of the container in an open manner and in operative cooperation with the internal facing surface of the container and the internal facing rim portion of the container. The result of this tension arrangement is to substantially prevent the development of a gap between the handled bag and the internal facing rim portion of the container.

It will be understood the liner receiving opening 58 could also be stamped or formed with a cammed mold, in which case the bevel may or may not be added as desired.

While the above contains many specificities, the reader should not construe these as limitations on the scope of the invention, but merely as exemplifications of preferred embodiments thereof. Those skilled in the art will envision many other variations within its scope. For example, skilled artisans will readily be able to make the fastening devices from different materials, such as plastic or metal. The fasteners may be made in any shape, or can even be recessed into the side of the container. The drawings show a rectangular trash container, but the fastening devices will work on containers to be used for any purpose. The fastening devices may be used on a bag filling stand, which may be used in conjunction with a scale to allow the contents of the bag to be weighed. The add on fastening devices may comprise a single fastening device, or more than two, and may be made in different shapes, such as with a rounded back for use with round containers, and may be attached to the containers in a variety of methods. Accordingly the reader is requested to determine the scope of the invention by the appended claims and their legal equivalent, and not by the examples which have been given.

The specific embodiments have been shown and the variety of combinations of the members will be recognized with the need to provide any additional detail. The particular shape and material may vary. The configuration and number of fasteners may also vary and the illustration of a single fastener or two opposing fasteners is not a limitation as to the combinations that may be provided.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A container suitable for securing a plastic bag with a handle or handles for use as a liner of the container, comprising:

a container having generally upright side portions and the side portions terminating in a substantially upright rim portion the rim portion defining a container mouth;

a fastener defined by a cutout in the side of the container, the fastener and cutout cooperating in such a manner that it is capable of gripping the handle of the plastic bag with at least one handle and a mouth to an external side of the container, the fastener provided without extension or projection from an external surface of the trash container, the cutout defining at least one slot opening in the trash container side and the slot opening proximate the fastener where the fastener is substantially co-planer with the side of the trash container, the fastener further defined by the cutout situated a sufficient distance below the rim of the container so as to work in cooperative association with the opposite external side of the container so as to increase the effective circumference of the mouth of the container, whereby the mouth of the plastic bag with its handle or handles is pulled against the opposite external side of the container, holding the mouth of the plastic bag around the rim of the container in an open manner and in operative cooperation with an internal facing surface of the container and the internal facing rim portion to substantially prevent the development of a gap between the handled bag and the internal facing rim portion of the container, wherein the fastener is provided with beveled portions to facilitate the molding of the container.

2. The container of claim 1 wherein the fastener includes a plurality of spaced apart tabs provided to accommodate the handle or handles of different sized plastic bags.

3. The container of claim 1 wherein said cutout is generally U-shaped.

4. The container of claim 1 wherein said cutout is generally decorative.

5. The container of claim 1 wherein the fastener and cooperating cutout may be added to the container.

6. The container of claim 1 wherein the fastener and cooperating cutout are provided during the original manufacture of the container.

7. The container of claim 1 wherein flashing from the molding of the container remains in the cooperating cutout.

* * * * *